US008342251B2

(12) United States Patent
Howlett et al.

(10) Patent No.: US 8,342,251 B2
(45) Date of Patent: Jan. 1, 2013

(54) SHOE FOR WELLBORE LINING TUBING

(75) Inventors: Paul Howlett, Aberdeen (GB); Michael Wardley, Laurencekirk (GB)

(73) Assignee: Tercel Oilfield Products UK Limited, Aberdeen (GB)

( * ) Notice: Subject to any disclaimer, the term of this patent is extended or adjusted under 35 U.S.C. 154(b) by 459 days.

(21) Appl. No.: 12/523,441

(22) PCT Filed: Jan. 21, 2008

(86) PCT No.: PCT/GB2008/000192
§ 371 (c)(1),
(2), (4) Date: Oct. 8, 2009

(87) PCT Pub. No.: WO2008/087446
PCT Pub. Date: Jul. 24, 2008

(65) Prior Publication Data

US 2010/0065281 A1 Mar. 18, 2010

(30) Foreign Application Priority Data

Jan. 19, 2007 (GB) ..... 0701115.8

(51) Int. Cl.
*E21B 33/14* (2006.01)

(52) U.S. Cl. ..... 166/386; 166/242.8; 166/177.4

(58) Field of Classification Search ..... 166/381, 166/386, 387, 129, 145, 285, 242.8, 177.4
See application file for complete search history.

(56) References Cited

U.S. PATENT DOCUMENTS

| | | | | |
|---|---|---|---|---|
| 2,144,842 | A * | 1/1939 | Hanes | 166/150 |
| 6,223,823 | B1 * | 5/2001 | Head | 166/290 |
| 2002/0144813 | A1 | 10/2002 | Allamon et al. | |
| 2003/0098163 | A1 | 5/2003 | Hebert et al. | |

FOREIGN PATENT DOCUMENTS

| | | | |
|---|---|---|---|
| GB | 2 371 575 | A | 7/2002 |
| WO | 98/48143 | A1 | 10/1998 |
| WO | 01/69037 | A1 | 9/2001 |
| WO | 2007/012842 | A1 | 2/2007 |

* cited by examiner

*Primary Examiner* — David Andrews
(74) *Attorney, Agent, or Firm* — Sughrue Mion, PLLC

(57) ABSTRACT

Provided is a shoe for wellbore lining tubing and to a method of locating wellbore lining tubing in a wellbore. In particular, but not exclusively, the present invention relates to a shoe for wellbore tubing having an improved fluid flow diverter assembly for controlling circulation of fluid in the wellbore.

20 Claims, 5 Drawing Sheets

SHOE FOR WELLBORE LINING TUBING

CROSS REFERENCE TO RELATED APPLICATIONS

This application is a National Stage of International Application No. PCT/GB2008/000192, filed Jan. 21, 2008, claiming priority based on British Patent Application No. 0701115.8, filed Jan. 19, 2007, the contents of which are incorporated herein by reference in their entirety.

The present invention relates to a shoe for wellbore lining tubing and to a method of locating wellbore lining tubing in a wellbore. In particular, but not exclusively, the present invention relates to a shoe for wellbore lining tubing having an improved fluid flow diverter assembly for controlling circulation of fluid in the wellbore.

In the oil and gas exploration and production industry, a wellbore or borehole is drilled from surface to gain access to subterranean hydrocarbon-bearing rock formations. The wellbore is typically drilled to a first depth, and wellbore lining tubing known as casing is located in the drilled wellbore and is cemented in place. The casing both supports the drilled rock formations and prevents undesired fluid ingress. The wellbore is then typically extended, and a smaller diameter casing is located within the extended section, passing through the first casing to surface. This is repeated as necessary to gain access to a producing formation. Often, a wellbore lining tubing known as a liner is coupled to and extends from the bottom of the lowermost casing section, to gain access to a producing formation.

Whilst this method has been employed for many years in the industry, there are disadvantages associated with lining a wellbore in this fashion. In particular, in the installation of smaller diameter casing sections within outer, larger diameter casings, it is necessary to pump fluid down through the smaller diameter casing and into the wellbore. This fluid flows up the extended wellbore, into the larger diameter casing and to surface, carrying residual solid debris present in the wellbore. Once the smaller diameter casing has been located at a desired position, the casing is cemented in place.

Relatively large radial spacings are required between concentric sections of smaller diameter casings in order to allow fluid flow along the casing sections during running and cementing. As a result, outer casing diameters are relatively large, causing significant material wastage, particularly as each casing section extends to surface. Furthermore, the process of drilling the relatively large diameter upper sections of the wellbore produces large volumes of drill cuttings, which must be stored for cleaning pending safe disposal. Also as each casing string is cemented in place, large volumes of cement are required.

In an effort to address these disadvantages, it has been proposed to seek to reduce the radial spacings between the casing sections. However, this has required development of alternative methods and tools for circulating fluid into the drilled wellbore. U.S. Pat. No. 6,223,823 discloses a method of installing a casing section in a well where a flow path is provided through an annular space between lowering means for lowering a casing section into an existing casing.

Whilst the apparatus and method of U.S. Pat. No. 6,223,823 provides a significant step forward from conventional casing installation methods and apparatus, it is generally desired to improve upon the disclosed structure and method. In particular, is desirable to improve operational reliability to reduce downtime and cost, to reduce cost of manufacture, and to facilitate sourcing of components.

It is therefore amongst the objects of embodiments of the present invention to obviate or mitigate at least one of the foregoing disadvantages. In particular, in embodiments of the present invention, it is an object to provide an improved shoe for wellbore lining tubing and an improved method of locating wellbore lining tubing in a wellbore.

According to a first aspect of the invention, there is provided a shoe for wellbore lining tubing, the shoe comprising:

an outer tubular body adapted to be coupled to wellbore lining tubing, the outer tubular body having at least one flow port for fluid communication between the wellbore and an interior of the outer body;

an inner body located within the outer tubular body and adapted to be coupled to fluid supply tubing located within the wellbore lining tubing for the flow of fluid through the tubular inner body into the wellbore;

a flow diverter assembly being operable to be moved between a first position in which fluid flow from the wellbore to an annulus defined between the wellbore lining tubing and the fluid supply tubing is permitted, and a second position in which fluid flow from the wellbore to an annulus defined between the wellbore lining tubing and the fluid supply tubing is prevented;

actuating means for actuating movement of the flow diverter assembly between its first and second positions;

wherein the shoe is adapted such that, upon actuation, the flow of fluid from the fluid supply tubing into the wellbore is prevented until the flow diverter assembly is in its second position.

Preferably, the flow diverter assembly is adapted to permit circulation of fluid through the shoe when in its first position.

Preferably, the actuating means has a first configuration in which the movement of the flow diverter assembly is actuated and flow of fluid into the wellbore is prevented, and a second configuration in which flow of fluid into the wellbore is permitted. Preferably, the actuating means is only in its second configuration when the at least one flow port is sealed.

Actuation of the flow diverter assembly may be by fluid pressure.

Preferably, the actuating means comprises a flow stemming member, such as a ball, and a release mechanism for the flow stemming member. More preferably, the release mechanism is actuated when the flow diverter assembly is in its second position. Preferably, the release mechanism is prevented from engaging with the flow diverter assembly when in its first position.

Preferably, the shoe comprises at least one fluid flow channel defined by the tubular inner body for selective return flow of fluid from the wellbore along the shoe, into the channel, and into the annulus defined between the fluid supply tubing and the wellbore lining tubing. The fluid flow channel may be defined between the outer body and the tubular inner body. The fluid flow channel may be formed in the tubular inner body. The fluid flow channel may have a circular cross-section.

The actuating means may comprise a seat adapted to receive a flow stemming member. The seat may have a release mechanism.

The flow stemming member may be adapted to couple with the seat to prevent fluid flow through the inner body into the wellbore, and whereupon the flow diverter assembly experiences a fluid pressure force that causes the diverter assembly to move from the first position to the second position.

The actuating means may be coupled to the flow diverter assembly, such that upon actuation, movement of the flow diverter assembly to the second position causes the actuating means to enter its second configuration.

Thus in use, the shoe with the flow diverter assembly in its initial position with flow ports open permits fluid to be directed from surface via the fluid supply tubing through the assembly and the inner body to wellbore, and return fluid in the wellbore flows along the shoe and into an annulus between the fluid supply tubing and the lining tubing. This facilitates location of the shoe and lining tubing in position in the wellbore. When it is desired to alter the flow path to prevent return of fluid into the annulus from the wellbore, for example, when cementing the lining tubing in place, a stemming member, for example a ball, received in the seat, which when received in the seat leads to a pressure increase in the supplied fluid that is felt by the flow diverter assembly as force causing it to move into a second position, to thereby block the path to the annulus. With the return path blocked, the seat can then be de-coupled from the assembly by the release mechanism, allowing flow of fluid through the tubular body into the wellbore again, for example, to enable cementation.

Advantageously therefore, this shoe provides for "failsafe" operation in that the seat cannot be released before the return flow of fluid from the wellbore through the shoe and into the annulus is blocked.

Preferably, the release mechanism includes a release member longitudinally separated from an end of the flow diverter assembly. More specifically, the release member may be spatially separated from a first or leading end of the flow diverter assembly by a distance greater than that over which the diverter assembly is movable while the flow ports are open, i.e. while the flow ports are in fluid communication with the wellbore and an interior of the shoe. This way the release member cannot engage with the diverter assembly until after the flow ports are closed.

The release member may be further adapted to support the tubular inner body in the second position, and may be adapted to limit further movement of the flow diverter assembly relative to the outer body. The release member may also be adapted to receive a decoupled seat. The release member may be in the form of a catcher body located fixed to the outer body.

The release member may be adapted to impart a mechanical force to the flow diverter assembly or actuating means. Where the same comprises a seat, it may decouple or detach the seat from the tubular inner body and/or the flow diverter assembly. The seat may be coupled and/or connected to the inner tubular body via at least one seat/inner tubular shear pin, which is adapted to shear upon engagement of the flow diverter assembly with the release member.

Preferably, the diverter assembly is adapted to be connected to the outer body in the initial position via shear pins, which are adapted to shear on exposure of the flow diverter assembly to supplied fluid pressure upon abutment of the stemming member in the seat.

Accordingly, it will be understood that the diverter assembly as a whole can move from the first position to close the flow ports and for engagement with the release mechanism. The diverter assembly may be adapted to locate against or abut against the release member in the second position for engagement of the release member with the diverter assembly. More specifically, a leading or first end of the diverter assembly and/or tubular inner body is adapted to engage with and/or make contact with the release member in the further position for releasing the ball seat.

In addition, the diverter assembly may comprise a collet located within and coupled to the tubular inner body toward a first or leading end of the assembly to provide a mechanical force to the seat upon engagement of the leading end of the assembly with the release means. The collet may be located in abutment with the seat to provide support for the seat. Further, the collet may comprise prongs adapted to be located in abutment with a ledge in the tubular body. In this arrangement of the diverter assembly, pressure force exerted on the stemming member and/or seat from a top end of the assembly seat, i.e. from the fluid supply tubing, may be conveyed to the tubular body for movement of the tubular body and the diverter assembly as a whole.

The collet may protrude the end of the assembly to engage with the release member. The collet is adapted to convey a force to the seat upon engagement with the release member to shear the seat/inner tubular shear pin and to decouple the seat. The collet may be connected to the tubular inner body by a collet/inner tubular shear pin, which is adapted to shear upon engagement of the collet with the release means.

Preferably, the release member is adapted to connect with the tubular inner body of the diverter assembly for preventing movement of the assembly and/or tubular inner body within the outer body of the shoe. This prevents damage to internal components of the shoe after engagement of the diverter assembly with the release member. More specifically, the release member may be formed with a castellation adapted to enable connection of the diverter assembly and/or tubular inner body to the release means. The castellation may be adapted to prevent relative rotation between the diverter assembly and/or tubular inner body and the tubular receiving body.

The at least one fluid flow channel may be defined by the tubular inner body for selective return flow of fluid from the wellbore along the shoe, into the channel, and into the annulus defined between the fluid supply tubing and the wellbore lining tubing. The fluid flow channel may be defined between the outer body and the tubular inner body. The fluid flow channel may be formed in the tubular inner body. The fluid flow channel may have a circular cross-section.

The shoe may comprise a plurality of fluid flow channels distributed around a circumference of the tubular inner body. A first channel may be formed with a first cross-sectional dimension, and a second fluid flow channel may be formed with a second cross-sectional on an opposing side of the circumference. This allows larger debris, for example, drill cuttings, to be carried in the return flow through the tool in the first channel and into the annulus.

Preferably, the flow port is adapted to selectively align with an entrance of the at least one fluid flow channel for fluid communication between the fluid flow channel and the fluid flow port.

Preferably, the shoe further comprises a valve assembly adapted to prevent back flow of fluid from the wellbore into the fluid supply tubing. The valve assembly is preferably located within the tubular body in spatial separation from the flow control assembly and/or the ball seat release means.

The valve assembly may comprise at least valve adapted to permit flow from the fluid supply tubing through the tubular inner body and into the wellbore, and adapted to prevent back flow of fluid from the wellbore past the valve assembly and into the tubular inner body. The valve may be a poppet valve. This advantageously prevents fouling and interference during operation of the shoe. Poppet valves are preferred as they are reliable in use.

Preferably, the valve assembly preferably comprises a second valve adapted to prevent back flow of fluid from the wellbore past the valve assembly. This provides extra reliability and failsafe performance.

Preferably, the valve assembly is bonded and/or sealed in place within the outer body using a bonding material. More specifically, the valve assembly may be cement bonded in place. The bonding material may comprise a phenolic plastics material.

Preferably, the shoe comprises an inner coupling body adapted to couple the fluid supply tubing to the inner tubular body. Further, the inner coupling may be connected to a receptacle for receiving a stinger assembly for sealably connecting the fluid supply tubing via the inner coupling body to the tubular inner body.

According to a second aspect of the present invention, there is provided a method of locating wellbore lining tubing in a wellbore, the method comprising the steps of:

a. coupling a shoe to a wellbore lining tubing to be located in a wellbore;
b. running the wellbore lining tubing and the shoe into the wellbore;
c. directing fluid along a fluid supply tubing located within the wellbore lining tubing, through an inner body of the shoe coupled to the fluid supply tubing and into the wellbore;
d. permitting return flow of fluid from the wellbore into a flow channel through at least one flow port of the outer body;
e. stemming flow from the fluid supply tubing while sealing the shoe to prevent fluid flow from the wellbore to the flow channel.

The method may comprise the additional step of permitting flow from the fluid supply tubing after the shoe is sealed to prevent fluid flow from the wellbore to the flow channel.

The method may comprise the additional step of actuating movement of a flow diverter assembly by locating a stemming member on seat.

The method may comprise the additional step of releasing the stemming member to reopen fluid flow through the inner body into the wellbore.

The method may comprise the step of preventing flow of fluid back from the wellbore into the fluid supply tubing by using a valve assembly provided within the outer body. The valve assembly may be adapted to permit flow through the inner body into the wellbore and prevent flow back from the wellbore into the supply tubing.

The method may comprise the steps of inserting the stemming member into the supply tubing, and pumping the stemming member into the shoe via the supply tubing for landing on the seat.

The method may comprise the step of pressurising fluid supplied via the fluid supply tubing.

The method may include any of the features of the first aspect of the invention.

The shoe may be a shoe in accordance with the first and/or second aspects of the invention.

Embodiments of the present invention will now be described, by way of example only, with reference to the accompanying drawings, in which.

Figure 1:
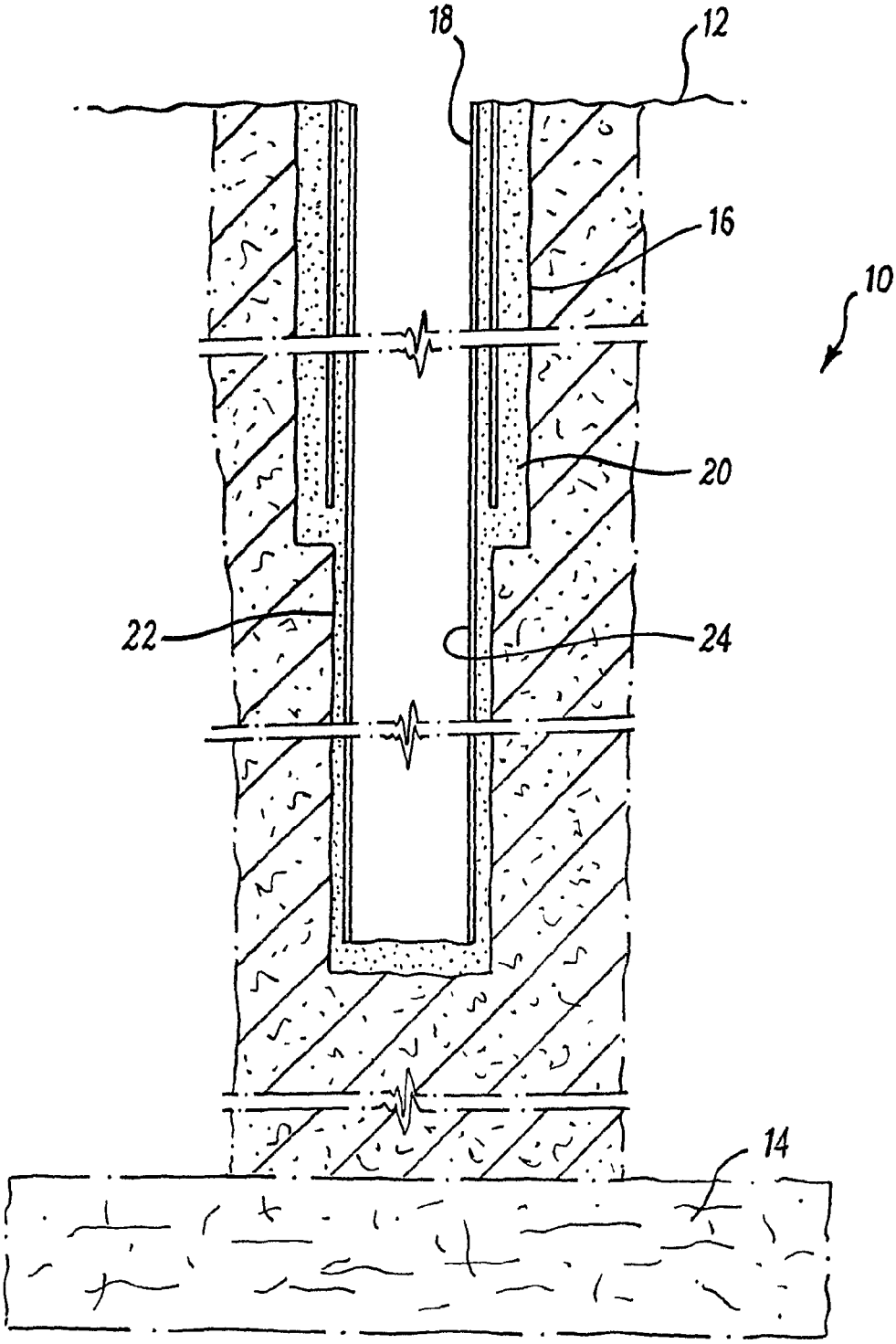
FIG. 1 is a longitudinal sectional view of a wellbore during drilling and lining with wellbore lining tubing.

Turning firstly to FIG. 1, there is shown a wellbore 10 during drilling and lining with wellbore lining tubing. As will be understood by persons skilled in the art, the wellbore 10 is drilled from surface 12 to gain access to a subterranean rock formation 14 containing well fluids including oil and/or gas. The wellbore 10 is shown in FIG. 1 following drilling of a first wellbore section 16 to a first depth, which has been lined with wellbore lining tubing in the form of a first casing section 18, and the casing section 18 has been cemented at 20, both to support the drilled rock formations, and to prevent undesired fluid ingress into the casing section 18. The wellbore 10 has then been extended to a second depth by drilling of a second, smaller diameter wellbore section 22, and a second, smaller diameter casing section 24 has been located within the first casing section 18, extending from the surface 12 through the first casing section 18. The second casing section 24 has then been cemented in place within the open wellbore section 22 and the first casing section 16, utilising the shoe of the present invention, which will be described.

Figure 2:
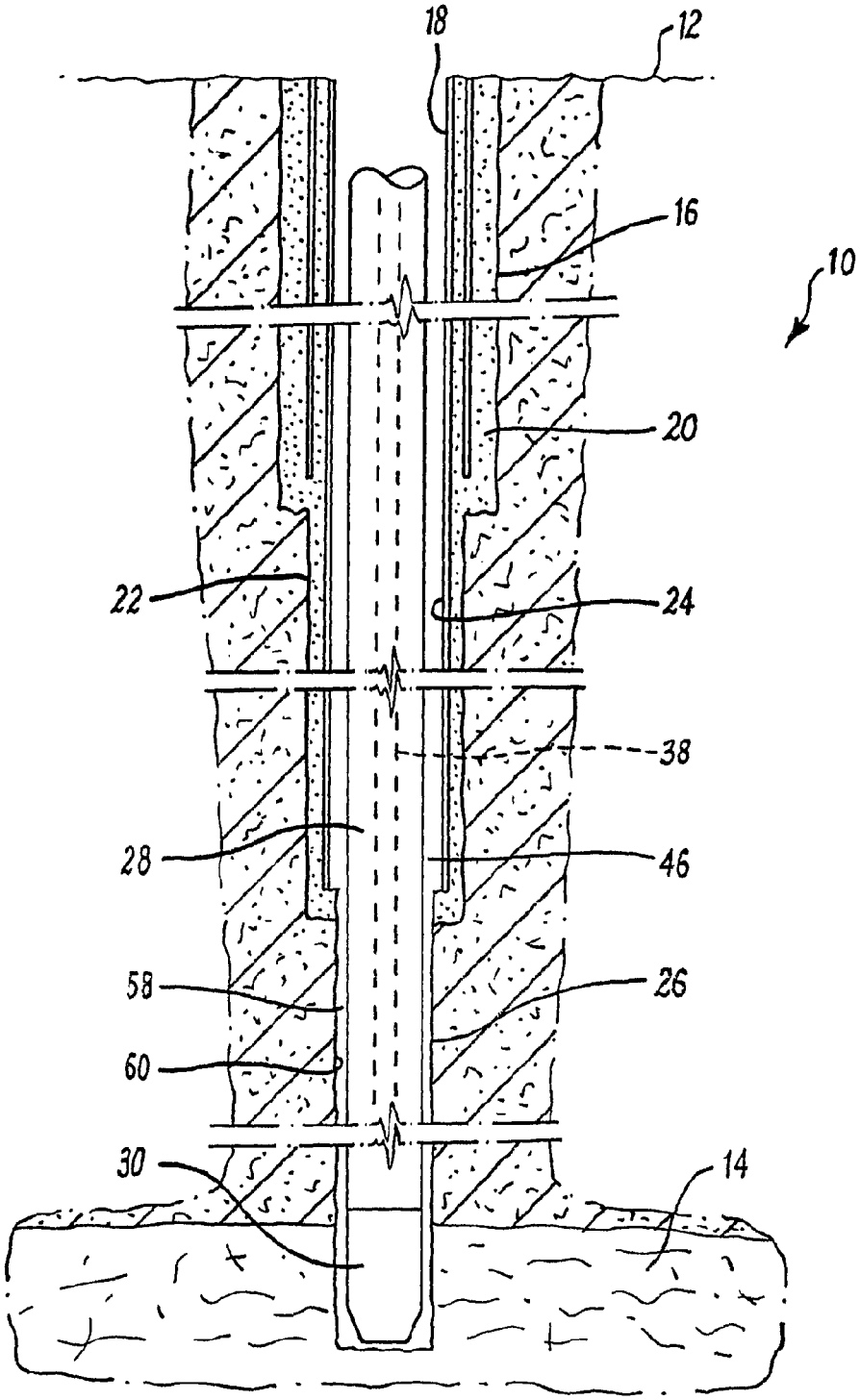
FIG. 2 is a view of the wellbore of FIG. 1 shown during installation of a section of wellbore lining tubing in an extended, open section of the wellbore, the wellbore lining tubing coupled to a shoe in accordance with a preferred embodiment of the present invention.

Turning therefore to FIG. 2, the wellbore 10 is shown following extension to a third depth by drilling of a third wellbore section 26 of smaller diameter than the second wellbore section 22, and is illustrated during installation of a third casing section 28 within the second casing section 22. A shoe 30 for wellbore lining tubing, in accordance with a preferred embodiment of the present invention, is coupled to the third casing section 28, and is utilised both to assist in running and cementing of the casing section 28. An outer annulus 58 is defined between the shoe 30 and casing 28 and a wall 60 of the wellbore section 26, which continues into the existing, second casing section 24 and thus to surface.

Figure 3:
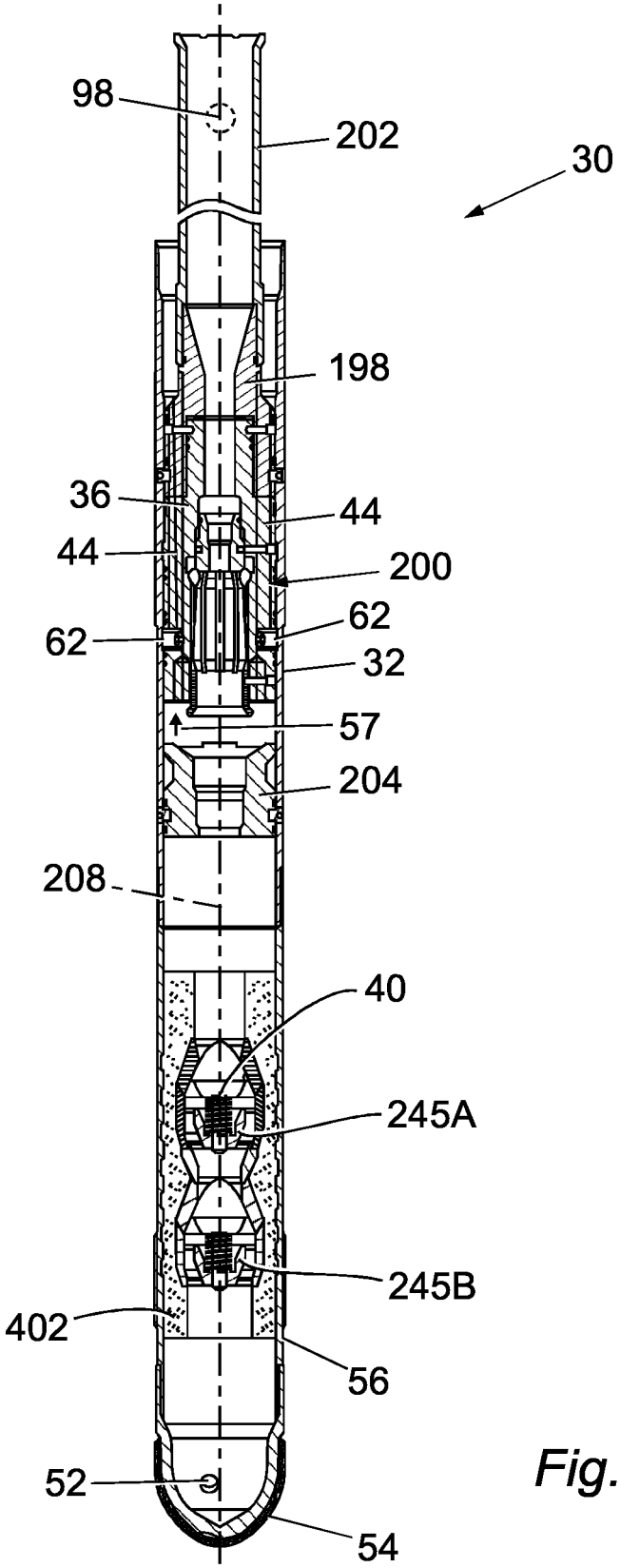
FIG. 3 is an enlarged longitudinal sectional view of the shoe of FIG. 2.

The shoe 30 is also shown in the enlarged, half-sectional view of FIG. 3, separately from the wellbore 10, for ease of illustration. The shoe 30 takes the form of a flow-diverter shoe, and serves both for circulating fluid into the wellbore 10 during running and installation of the casing section 28, and for subsequently controlling the supply of cement into the wellbore 10, for sealing the casing 28 in the wellbore 10.

Generally, the shoe 30 includes a tubular outer body 32 which is coupled to the casing section 28. Coupling may be achieved through an intermediate coupling sub, although it will be understood that the outer body 32 may alternatively be coupled directly to the casing 28. Toward an upper end of the shoe 30, the shoe includes a tubular coupling body 198, which is located within the outer shoe body 32 and is coupled to fluid supply tubing 38 via receptacle 202. The fluid supply tubing 38 is located within and extends through the casing 28, and is shown in broken outline in FIG. 2.

Moving toward a lower end of the shoe, the shoe 30 has a diverter assembly 200 comprising a tubular inner body 36, which is located within the outer body 32. Multiple flow channels 44 are formed in the flow diverter assembly 200, distributed circumferentially in the inner body 36 and the tubular coupling body 198. The diverter shoe 30 outer body 32 is provided with a plurality of flow ports 62 spaced around a circumference of the outer body 32. In the configuration of FIG. 3, the flow ports 62 are open and in fluid communication with the flow channels 44, such that fluid can enter the shoe 30 from the wellbore and can flow through the ports 62 into flow channels 44, and thus up along the shoe 30 into the annulus 46 defined between the fluid supply tubing 38 and the casing 28. Thus in this configuration, there is a flow path from the wellbore to the annulus defined between the wellbore lining tubing and the fluid supply tubing 202 via the ports 62 and the flow channels 44.

Below the diverter assembly is located a catcher body 204, the function of which is described in more detail below.

Toward the lower end of the shoe 30, there is included a valve assembly 40 comprising first and second valve in the form of poppet valves 245*a* and 245*b*, which are serially aligned along the shoe main axis 208 and exposed to the flow of fluid from the supply tubing 38 through the shoe 30. The valves function to prevent flow of fluid back from the wellbore 10 through the flow diverter assembly 200 and inner body 36 into the fluid supply tubing 38.

In the lower end of the shoe, and below the tubular receiving body 204, the valve assembly 40 is cemented in place within the outer shoe body 32 with a phenolic plastics material 402 filling the space around the valve assembly, keeping the assembly rigidly and securely in place.

In this embodiment, the tubular coupling body 198, the tubular inner body 36 of flow diverter assembly 200, and the tubular receiving body 204 and are concentrically aligned with main axis 208 of the shoe.

The shoe 30 operates in first mode for running, and a second mode for cementation of the casing section 28.

The tool is selectively actuated to operate in the second mode when the casing section is at the desired location, as is described in more detail below.

The flow diverter shoe 30 is used as follows. During run-in of the casing 28, fluid such as drilling fluid is circulated into the wellbore 10, to ease passage of the casing. The fluid is pumped down through the fluid supply tubing 38 and flows through the shoe 30 inner body 36, through the catcher body 204 and valve assembly 40 exiting into the open section 26 of the wellbore 10 through an inclined passage 52 provided in a nose 54 of the shoe 30. Fluid flowing into the wellbore section 26 through the passage 52 then flows upwardly along an external surface 56 of the shoe 30. However, the radial spacing between the second, larger casing 22 and the third casing section 28 is minimal, and a significant portion of the fluid is diverted and returns from the wellbore into the shoe 30 via flow ports 62 and into the annulus 46 defined between the fluid supply tubing 38 and the casing 28.

It will be understood that the fluid returning from the wellbore 10 into the shoe 30 carries entrained solid debris (such as drill cuttings, cement residue or the like present in the wellbore 10 following earlier downhole procedures), and the flow channels 44 are configured to accommodate the passage of such debris. The dimensions of the inner body 36 are such that there is a volume large enough to accommodate flow channels 44 of size large enough to accommodate debris, without reducing the strength of the body to an unacceptable level. In alternative embodiments, the flow channels may have differing cross-sectional dimensions or channel widths to accommodate debris, the larger channels accommodating larger pieces of debris and consequently reducing the likelihood of blockage in the flow channels to facilitate reliable and proper operation of the shoe 30 during the run-in phase.

The flow diverter assembly 200 is operable to move from the first configuration shown in FIG. 3, to a second position (not shown), where the ports 62 are closed off or blocked. In this second position, return fluid is prevented from flowing into the flow channels 44 to the surface via the annulus 46. Thus, the flow channels 44 serve to provide the selective return flow of fluid from the wellbore 10 into the shoe 30, and into an annulus 46 (FIG. 2) defined between the casing 26 and the fluid supply tubing 38, and the assembly 200 generally functions to control the flow of fluid into the wellbore.

Figure 4:
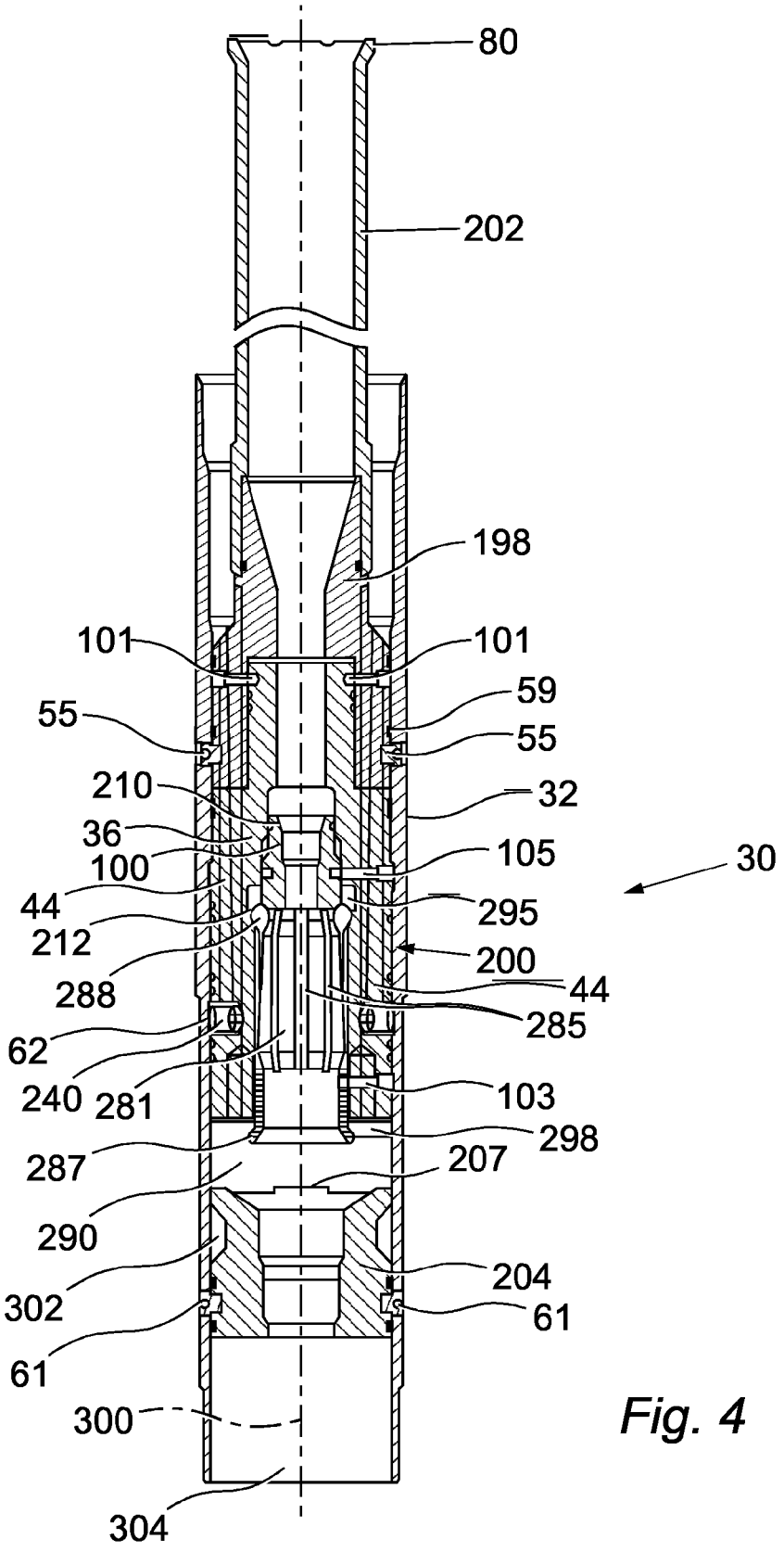
FIG. 4 is an enlarged longitudinal sectional view of the flow diverter assembly of the shoe of FIGS. 2 and 3.
Figure 5:
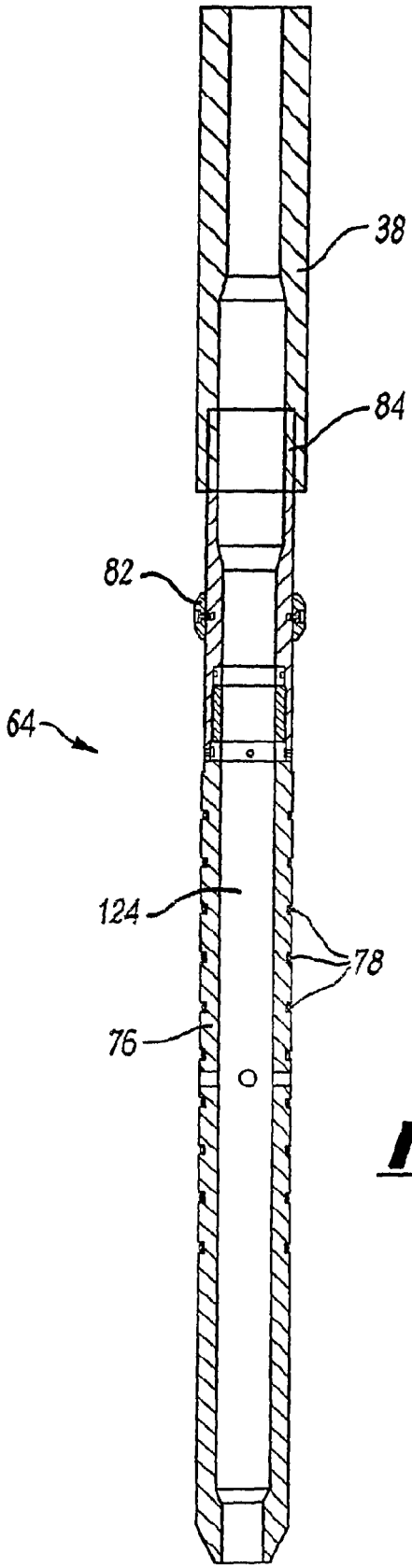
FIG. 5 is a longitudinal, half-sectional view of a stinger assembly utilised to couple the shoe of FIGS. 2 to 4 to fluid supply tubing.

With further reference to FIG. 4 showing the upper portion of the shoe and FIG. 5 showing a stinger assembly, the operation and structure of the diverter assembly is described in more detail.

Toward the upper end of the shoe 30, the tubular coupling body 198 located within the outer tubular shoe body 32 is fixed to the outer body 32 by fixing pins 55, and o-rings 59 are provided around the tubular shoe body to provide a fluid seal of the tubular shoe coupling body against an inner surface of the shoe body 32. The coupling body 198 is provided with a receptacle 202 connected to it for receiving a stinger assembly 64 (FIG. 5) to provide a sealed connection between the coupling body 198 and the fluid supply tubing 38. The stinger assembly 64 includes a stinger 76 which is received within the receptacle 202, and the stinger 76 carries a number of O-rings or similar seals 78, which provide a seal between the stinger 76 and the receptacle 72. The receptacle 202 includes an upper flange 80 which defines a seat for abutting a shear ring 82 on the stinger 76, to prevent the stinger 76 from passing entirely into the receptacle 202. The stinger 76 has a central bore 124 and is coupled at an upper end 84 to a lower section of the fluid supply tubing 38, and thus provides a sealed connection between the supply tubing 38 and the inner body 36. Providing the stinger 76 ensures that the fluid supply tubing 38 is sealed relative to the shoe inner body 36 irrespective of a relative axial position of the fluid supply tubing 38 within the casing section 28.

Between the tubular coupling body 198 and the catcher body 204, there is located the flow diverter assembly 200 comprising the tubular inner body 36, which is in fluid communication with the tubular coupling body 198 along its main tubular axis and is coupled to the fluid supply tubing. The flow diverter assembly 200 in the open configuration of FIGS. 3 and 4 is also located such that entrances 240 to the flow channel 44 are aligned with the flow ports 62 in the outer body to allow fluid to flow from the wellbore annulus between the shoe and the well bore through the port 62 and into the channel 44 and thereby subsequently to surface via the annulus 46 between the fluid supply tubing and an inner surface of the casing.

The assembly 200 also includes a ball seat 100 located within the tubular inner body 36 around the main tubular axis. The ball seat itself has a tubular structure allowing flow of fluid through the tubular inner body 36 and through the ball seat 100.

The ball seat 100 is coupled to tubular inner body 36 and located in place by a ball seat/inner tubular shear pin 105. The ball seat 100 functions to receive a ball 98 to stem and/or prevent the flow of fluid through the flow diverter assembly. More specifically, the ball seat 100 is formed with an inwardly protruding and slanting seat surface 210 around its central axis, against which a ball may rest to stem the flow. The ball 98 can be introduced to the shoe to actuate the shoe 30 and the assembly by pumping it down the fluid supply tubing 38 when required.

The flow diverter assembly further includes a collet 281 also coupled to and located in place relative to the tubular inner body 32 by a collet/inner tubular shear pin 103. The collet 281 has a generally tubular structure and has a body formed with longitudinal prongs 285. The collet 281 is located and retained within the tubular inner body 32 below the ball seat 100 and exerts a degree of outward radial bias toward the tubular inner body 36. The body of the collet 281 may be formed from a flexible and/or resilient material. The prongs 285 may also be formed to provide outward bias.

At an upper end, the prongs 285 terminate in outwardly protruding heads 288, which abut an inwardly protruding sloping ledge 212 of the tubular inner body. The heads 288 also abut a bottom edge surface of ball seat 100, such that the collet 281 and tubular inner body 36 act to provide support for the ball seat 100. In this way, in the configuration of FIGS. 3 and 4, the heads 288 are located between the bottom edge of the ball seat and the ledge 212 providing support. At the lower end, the collet has an end rim 287, which protrudes from or extends beyond the lower end 298 of the tubular inner body 36 as the lowermost point of the flow diverter assembly 200.

In the configuration of FIGS. 3 and 4, the flow diverter assembly 200 is coupled and temporarily connected to the tubular coupling body 198 toward the upper end of the assembly. The assembly is connected via diverter assembly shear pins 101. It will be appreciated that in other embodiments the flow diverter assembly may be coupled directly to the outer shoe body 32.

Further, the lower end of the flow diverter assembly 200 is separated by a first flow space 290 from the upper end of the catcher body 204. The catcher body 204 is fixed against the outer body 32 of the shoe by fixing pins 61. The tubular receiving body has a central main flow channel 300 and secondary smaller dimensioned flow channels 302 both suitable for flow of fluid from the fluid supply tubing into the lower flow space 304.

Fluid flow is then controlled by actuation of the flow diverter assembly in the following way. When the shoe and wellbore lining tubing have been lowered or run-in to the desired location in the wellbore, for example, for performing cementation of the wellbore tubing lining, the ball 98 is inserted to the fluid supply tubing and is allowed to flow into and down along the main axis of the shoe into the diverter assembly where it comes to rest on the ball seat 100 within the tubular inner body 32.

With the ball located in the valve seat 100, flow is prevented through the tubular inner body 36, producing a back pressure or a pressure increase in the supplied fluid. As a result of the pressure increase, the flow diverter assembly 200 experiences an increased downward force through the coupling of the ball seat 100 and collet 281 to the tubular inner body 34, causing the diverter assembly shear pins 101 to shear. The diverter assembly 200 is forced under pressure to move from the initial position of FIGS. 3 and 4, where the flow ports 62 are aligned with the flow channel entrances 240, to a second position where the flow channel entrances 240 have become misaligned with the flow ports such that flow from the wellbore into the flow channels 44 is prevented.

The flow diverter assembly 200 is pushed toward and against the catcher body 204 such that the collet end rim 287 contacts the tubular receiving body 204, which then forces the collet 281 upwards and shears the collet/inner tubular shear pin 103. As the collet 103 is pushed upwards, the prongs heads 288 deflect outward toward the recess 295 of the inner tubular body, releasing the ball seat. The ball seat is now unsupported, and the force of the fluid pressure causes the ball seat/inner tubular shear pin 105 to shear, to decouple the ball seat from the flow diverter assembly 200. The released ball seat rapidly downward through the collet main body.

On exiting the collet 281, the ball seat with the ball located in the seat is received or caught in the catcher body 204, such that the main flow channel 300 is blocked. The supplied fluid continues to flow through the secondary channels 302 and on through the tool and into the wellbore, however without return flow from the wellbore through the flow ports 62.

Further, the catcher body 204 is provided with a castellation 207, which is adapted to interlock with the collet and the flow diverter assembly when in engagement with the tubular receiving body 204. The castellation 207 functions to prevent rotation of the flow diverter assembly and the collet within the shoe after actuation, assisting in subsequent drilling out of the shoe.

The present shoe 30 facilitates reliable actuation of the shoe when located in position for cementation, and offers advantages over prior art methods of lining a wellbore including reduced risk of failure, incorporation of industry standard components with consequent cost savings in particular in terms of manufacturing and/or sourcing and drilling time. The above-described structure and operation of the shoe is particularly advantageous as accidental release of the ball seat is prevented. The ball seat cannot be released unless the flow diverter assembly is in moved such the tubular receiving body 204 has engaged with the collet 281. Further, in the furthest position at which the catcher body 204 engages with the collet 281, the flow ports have already closed such that cement provided to the wellbore cannot enter into, foul and/or interfere with operation of the shoe. Thus, it provides for failsafe operation of the diverter shoe 30.

Separation of the valve assembly from the flow diverter assembly prevents the operation valves from interfering with operation of the flow diverter assembly and the shoe as described above. Further, poppet valves are used in other industry applications, are readily obtainable at low cost, and are reliable in operation. As the valve assembly does not interact with the flow diverter assembly in this longitudinally separated configuration, space is freed up for the diverter assembly, and in particular, more space is available for provision of flow channels 44 in the tubular inner body 36.

Various modifications may be made to the foregoing without departing from the spirit and scope of the present invention. For example, the shoe may be suitable for use with other types of downhole tubing where fluid is directed through the tubing into the wellbore, or casing/liner in the wellbore, in use.

The invention claimed is:

1. A shoe for wellbore lining tubing, the shoe comprising:

an outer tubular body adapted to be coupled to wellbore lining tubing, the outer tubular body having at least one flow port for fluid communication between the wellbore and an interior of the outer body;

an inner body located within the outer tubular body and adapted to be coupled to fluid supply tubing located within the wellbore lining tubing for the flow of fluid through the tubular inner body into the wellbore;

a flow diverter assembly being operable to be moved between a first position in which fluid flow from the wellbore to an annulus defined between the wellbore lining tubing and the fluid supply tubing is permitted, and a second position in which fluid flow from the wellbore to an annulus defined between the wellbore lining tubing and the fluid supply tubing is prevented;

actuating means for actuating movement of the flow diverter assembly between its first and second positions, the actuating means comprising a seat adapted to receive a flow stemming member and a release mechanism for the flow stemming member;

wherein the shoe is adapted such that, upon actuation, the flow of fluid from the fluid supply tubing into the wellbore is prevented until the flow diverter assembly is in its second position.

2. A shoe as claimed in claim 1, wherein the actuating means has a first configuration in which the movement of the flow diverter assembly is actuated and flow of fluid into the wellbore is prevented, and a second configuration in which flow of fluid into the wellbore is permitted and wherein the actuating means is only in its second configuration when the at least one flow port is sealed.

3. A shoe as claimed in claim 2 wherein the actuating means is coupled to the flow diverter assembly, such that upon actuation, movement of the flow diverter assembly to the second position causes the actuating means to enter its second configuration.

4. A shoe as claimed in claim 1, wherein the release mechanism is actuated when the flow diverter assembly is in its second position.

5. A shoe as claimed in claim 1, wherein the release mechanism is prevented from engaging with the flow diverter assembly when in its first position.

6. A shoe as claimed in claim 1, wherein the shoe comprises at least one fluid flow channel defined by the tubular inner body for selective return flow of fluid from the wellbore along the shoe, into the channel, and into the annulus defined between the fluid supply tubing and the wellbore lining tubing.

7. A shoe as claimed in claim 1 wherein the flow stemming member is adapted to couple with the seat to prevent fluid flow through the inner body into the wellbore, and whereupon the flow diverter assembly experiences a fluid pressure force that causes the diverter assembly to move from the first position to the second position.

8. A shoe as claimed in claim 1 wherein the release mechanism includes a release member longitudinally separated from an end of the flow diverter assembly.

9. A shoe as claimed in claim 8 wherein the release member is spatially separated from a first or leading end of the flow diverter assembly by a distance greater than that over which the diverter assembly is movable while fluid flow between the wellbore and an interior of the shoe is permitted.

10. A shoe as claimed in claim 8 wherein the release member is further adapted to support the tubular inner body when the flow diverter assembly is in the second position, and is adapted to limit further movement of the flow diverter assembly relative to the outer body.

11. A shoe as claimed in claim 8 wherein the release member is formed with a castellation adapted to enable connection of at least one of the diverter assembly and tubular inner body to the release mechanism.

12. A shoe as claimed in claim 11 wherein the castellation is adapted to prevent relative rotation between at least one of the diverter assembly and tubular inner body and the release member.

13. A shoe as claimed in claim 1 wherein the flow diverter assembly comprises a collet located within and coupled to the tubular inner body toward a first or leading end of the assembly to provide a mechanical force to the seat upon engagement of the leading end of the assembly with the release mechanism.

14. A shoe as claimed in claim 13 wherein the seat is coupled to the tubular inner body and located in place by a ball seat/inner tubular shear pin, and the collet is adapted to convey a force to the seat upon engagement with the release mechanism to shear the seat/inner tubular shear pin and to decouple the seat.

15. A shoe as claimed in claim 1 wherein the shoe further comprises a valve assembly adapted to prevent back flow of fluid from the wellbore into the fluid supply tubing.

16. A shoe as claimed in claim 15 wherein the valve assembly is located within the tubular body in spatial separation from at least one of the flow diverter assembly and the ball seat release means.

17. A shoe as claimed in claim 15 wherein the valve is a poppet valve.

18. A method of locating wellbore lining tubing in a wellbore, the method comprising the steps of:

a. coupling a shoe to a wellbore lining tubing to be located in a wellbore;

b. running the wellbore lining tubing and the shoe into the wellbore;

c. directing fluid along a fluid supply tubing located within the wellbore lining tubing, through an inner body of the shoe coupled to the fluid supply tubing and into the wellbore;

d. permitting return flow of fluid from the wellbore into a flow channel through at least one flow port of the outer body;

e. actuating movement of a flow diverter assembly by locating a stemming member on a seat and stemming flow from the fluid supply tubing while sealing the shoe to prevent fluid flow from the wellbore to the flow channel; and f. releasing the stemming member to reopen fluid flow through the inner body into the wellbore.

19. A method as claimed in claim 18, wherein the method comprises the step of preventing flow of fluid back from the wellbore into the fluid supply tubing by using a valve assembly provided within the outer body, and the valve assembly is adapted to permit flow through the inner body into the wellbore and prevent flow back from the wellbore into the supply tubing.

20. A method as claimed in claim 18, wherein the method comprises the steps of inserting the stemming member into the supply tubing, and pumping the stemming member into the shoe via the supply tubing for landing on the seat.

* * * * *